US005346422A

United States Patent [19]

Bagrodia et al.

[11] Patent Number: 5,346,422

[45] Date of Patent: Sep. 13, 1994

[54] TOY ARTICLES OF MANUFACTURE COMPRISING SPONTANEOUSLY WETTABLE FIBERS

[75] Inventors: Shriram Bagrodia, Kingsport; Bobby M. Phillips, Jonesborough; E. Phillip Smith, Blountville; Kenny R. Parker; Paul A. Rundquist, both of Kingsport, all of Tenn.

[73] Assignee: Eastman Chemical Company, Kingsport, Tenn.

[21] Appl. No.: 986,837

[22] Filed: Dec. 8, 1992

[51] Int. Cl.[5] ..... B32B 27/00

[52] U.S. Cl. ..... 446/394; 8/512; 8/532; 427/394; 428/297; 428/357; 428/364; 428/371; 428/375; 428/397; 428/913

[58] Field of Search ..... 428/297, 357, 364, 371, 428/375, 397, 913; 427/394; 446/385, 386, 391, 394; 8/115.6, 127.51, 532, 512

[56] References Cited

U.S. PATENT DOCUMENTS

| | | | |
|---|---|---|---|
| 3,382,607 | 5/1968 | Ryan et al. | 46/156 |
| 4,276,207 | 6/1981 | Lester et al. | 260/17 R |
| 4,781,647 | 11/1988 | Doane, Jr. | 446/219 |

*Primary Examiner*—James J. Bell

[57] ABSTRACT

This invention relates to an article of manufacture consisting of a toy having a plurality of synthetic fibers capable of spontaneously transporting water on the surface thereof, said fibers satisfying the following equation $$(1-X\cos\theta_a)<0,$$

wherein $\theta_a$ is the advancing contact angle of water measured on a flat film made from the same material as the fiber and having the same surface treatment, if any, X is a shape factor of the fiber cross-section that satisfies the following equation $$X=\frac{P_w}{4r+(\pi-2)D}$$

wherein $P_w$ is the wetted perimeter of the fiber and r is the radius of the circumscribed circle circumscribing the fiber cross-section and D is the minor axis dimension across the fiber cross-section.

30 Claims, 16 Drawing Sheets

LFA
LFA

LFA
LFA

LFA
LFA

Time
t=0
LFA
θ
LFA t=t1
LFA
θ
LFA t=t2
LFA
LFA
θ
LFA

TOY ARTICLES OF MANUFACTURE COMPRISING SPONTANEOUSLY WETTABLE FIBERS

CROSS-REFERENCE TO RELATED APPLICATIONS

This application is related to application Ser. No. 736,267 filed Jul. 23, 1991, a continuation in part of application Ser. No. 333,651 filed Apr. 4, 1989 abandoned. This application is also related to application Ser. No. 986,933, entitled "Substrate Comprising a Fabric Material Containing Spontaneously Wettable Fibers", commonly assigned and filed concurrently herewith.

FIELD OF THE INVENTION

The present invention concerns an article of manufacture consisting of a toy having a plurality of synthetic fibers capable of spontaneous transport of aqueous fluid and a process for surface coloration of the fibers.

BACKGROUND OF THE INVENTION

There is a growing interest in the toy industry for fibers which are useful in toys and which exhibit varying abilities to undergo color change. This interest is especially present in the area of children's dolls.

U.S. Pat. No. 3,382,607 discloses a toy having a visible portion comprising fibers permanently impregnated with an indicator dye capable of repeated and reversible color change in response to contact with liquids of different pH concentrations.

In U.S. Pat. No. 4,781,647, artificial doll hair is disclosed which is extruded from polymeric materials which is at least partially translucent, and which contains phosphorescent particles. The presence of the particles give unique color to the hairs without weakening the fiber. The polymeric material for the fiber can be a polyamide, polyester, polyolefin, polyacylonitrile, or polyvinyl chloride, coupled to the particles by silane or titanate coupling agent. In U.S. Pat. No. 4,276,207, pigment sensitized particles (PSP) are described as being completely encapsulated by the glycolate modified derivative. It is stated that the PSP particles will not stain the fiber regardless of composition and will wash out completely and easily with hot water, or mild soaping, hot or cold. It is further stated that the hair coloring of dolls was not possible with prior art dyestuffs since they would stain the doll's hair no matter what fiber was used—polypropylene, nylon, polyester, etc.

In other known processes, fibers are typically dyed using a thermal process.

SUMMARY OF THE INVENTION

The present invention relates to an article of manufacture consisting of a toy having a plurality of synthetic fibers capable of spontaneously transporting water on the surface thereof, said fibers satisfying the following equation $$(1 - X \cos \theta_a) < 0,$$

wherein $\theta_a$ is the advancing contact angle of water measured on a flat film made from the same material as the fiber and having the same surface treatment, if any, X is a shape factor of the fiber cross-section that satisfies the following equation $$X = \frac{P_w}{4r + (\pi - 2)D}$$

wherein $P_w$ is the wetted perimeter of the fiber and r is the radius of the circumscribed circle circumscribing the fiber cross-section and D is the minor axis dimension across the fiber cross-section.

The present invention also relates to a process for surface coloration of a plurality of fibers which are attached to an article of manufacture as described above, said process comprising the steps of surface coloration of the fibers with an aqueous surface colorant or surface colorants, rinsing said surface colorant with an aqueous fluid, preferably so that the surface colorant is completely washed out, and subsequent surface restoration of the fibers. These fibers are unique due to several properties including the ability to be colored with an aqueous surface colorant, rinsed out with an aqueous fluid such as water. Although any temperature of water may be used, it is preferred that the temperature of the water is room temperature. Further, the integrity of the fiber is not affected by the surface coloration and rinsing out with an aqueous fluid so that it is able to be recolored with an aqueous surface colorant without losing properties which would affect the appearance or usability of the doll's hair.

BRIEF DESCRIPTION OF THE DRAWINGS

FIG. 13B—a schematic representation of a desirable groove in a fiber cross-section.

FIG. 13C—a schematic representation of a desirable groove in a fiber cross-section illustrating the groove completely filled with fluid.

FIG. 14B—a schematic representation of a groove where bridging is possible in the fiber cross-section.

FIG. 14C—a schematic representation of a groove illustrating bridging of the groove by a fluid.

DETAILED DESCRIPTION OF THE INVENTION

The present invention concerns the use of synthetic fibers which are capable of spontaneously transporting water on the surface thereof. The fibers useful in this invention must satisfy the following equation $$(1-X\cos\theta_a)<0,$$

wherein $\theta_a$ is the advancing contact angle of water measured on a flat film made from the same material as the fiber and having the same surface treatment, if any, X is a shape factor of the fiber cross-section that satisfies the following equation $$X=\frac{P_w}{4r+(\pi-2)D}$$

wherein $P_w$ is the wetted perimeter of the fiber and r is the radius of the circumscribed circle circumscribing the fiber cross-section and D is the minor axis dimension across the fiber cross-section.

It is preferred that $$\gamma_{LA}\cdot\frac{12\pi\cdot10^{-4}}{\sqrt{\rho}}\cdot\sqrt{dpf}\cdot(1-X\cos\theta_a)\leqq-0.3,$$

wherein $\gamma_{LA}$ is the surface tension of water in air in dynes/cm, $\rho$ is the fiber density in grams/cc, and dpf is the denier of the single fiber.

It is preferred that X is greater than 1.2, preferably between about 1.2 and about 5, more preferably between about 1.5 and about 3, and more preferably greater than about 3.

It is further preferred that $$2\frac{r}{D}$$

for said fiber is greater than 1, preferably between 1.5 and 5.

Figures 1A, 1B, 1C, 2A, 2B, 2C:
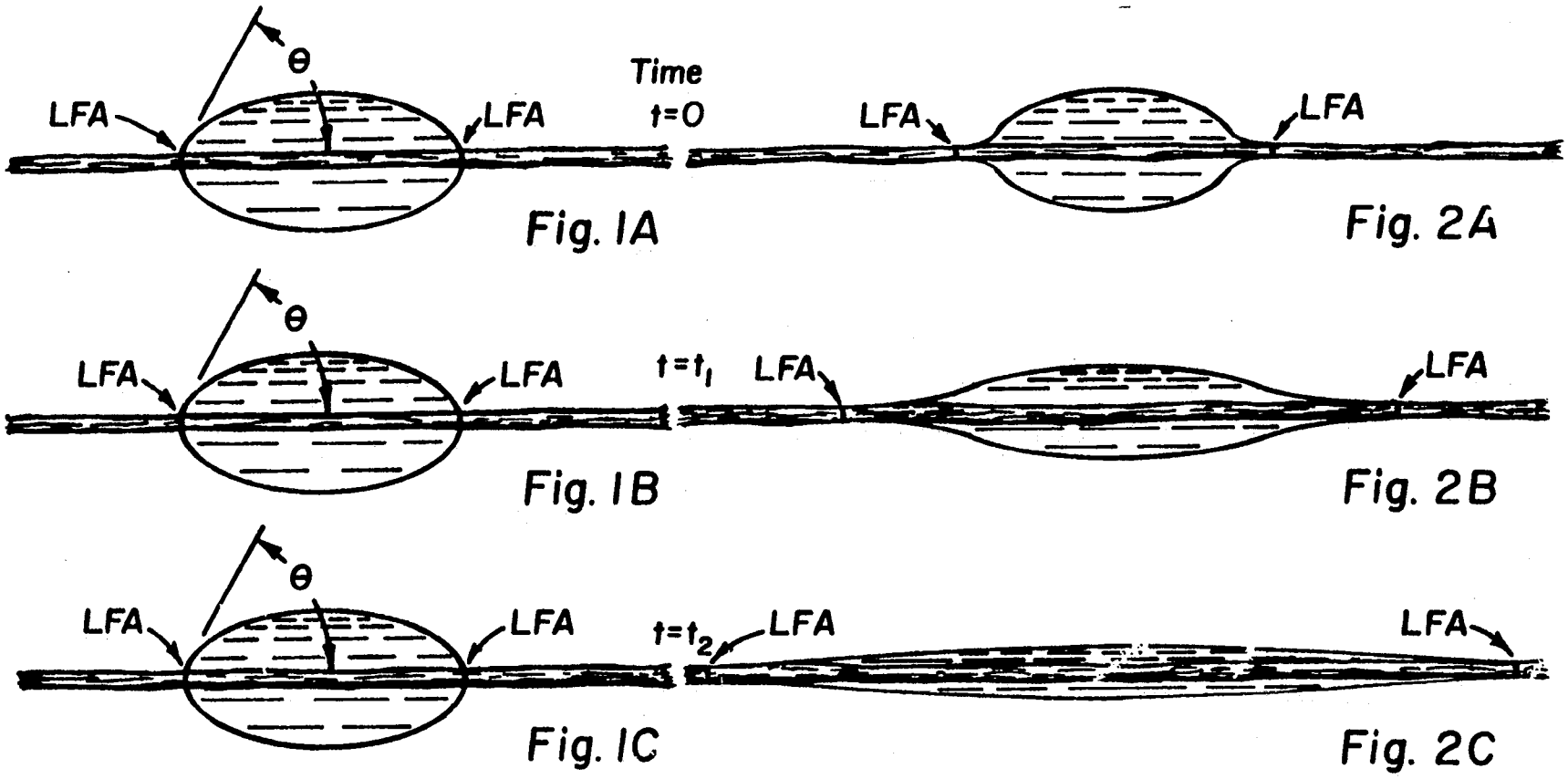
FIG. 1A—illustration of the behavior of a drop of an aqueous fluid on a conventional fiber that is not spontaneously transportable after the ellipsoidal shape forms (t=0). Angle $\theta$ illustrates a typical contact angle of a drop of liquid on a fiber. The arrows labelled "LFA" indicate the location of the liquid-fiber-air interface.
FIG. 1B—illustration of the behavior of a drop of an aqueous fluid on a conventional fiber that is not spontaneously transportable at time=$t_1$ ($t_1>0$). The angle $\theta$ remains the same as in FIG. 1A. The arrows labelled "LFA" indicate the location of the liquid-fiber-air interface.
FIG. 1C—illustration of the behavior of a drop of an aqueous fluid on a conventional fiber that is not spontaneously surface transportable at time=$t_2$ ($t_2>t_1$). The angle $\theta$ remains the same as in FIG. 1A. The arrows labelled "LFA" indicate the location of the liquid-fiber-air interface.
FIG. 2A—illustration of the behavior of a drop of an aqueous fluid which has just contacted a fiber that is spontaneously transportable at time=0. The arrows labelled "LFA" indicate the location of the liquid-fiber-air interface.
FIG. 2B—illustration of the behavior of a drop of an aqueous fluid on a fiber that is spontaneously transportable at time=$t_1$ ($t_1>0$). The arrows labelled "LFA" indicate the location of the liquid-fiber-air interface.
FIG. 2C—illustration of the behavior of a drop of an aqueous fluid on a fiber that is spontaneously transportable at time=$t_2$ ($t_2>t_1$). The arrows labelled "LFA" indicate the location of the liquid-fiber-air interface.

The three important variables fundamental to the liquid transport behavior are (a) surface tension of the liquid, (b) wettability or the contact angle of the liquid with the solid, and (c) the geometry of the solid surface. Typically, the wettability of a solid surface by a liquid can be characterized by the contact angle that the liquid surface (gas-liquid interface) makes with the solid surface (gas-solid surface). Typically, a drop of liquid placed on a solid surface makes a contact angle, $\theta$, with the solid surface, as seen in FIG. 1A. If this contact angle is less than 90°, then the solid is considered to be wet by the liquid. However, if the contact angle is greater than 90°, such as with water on Teflon® surface, the solid is not wet by the liquid. Thus, it is desired to have a minimum contact angle for enhanced wetting, but definitely, it must be less than 90°. However, the contact angle also depends on surface inhomogeneities (chemical and physical, such as roughness), contamination, chemical/physical treatment of the solid surface, as well as the nature of the liquid surface and its contamination. Surface free energy of the solid also influences the wetting behavior. The lower the surface energy of the solid, the more difficult it is to wet the solid by liquids having high surface tension. Thus, for example, Teflon, which has low surface energy does not wet with water. (Contact angle for Teflon-water system is 112°.) However, it is possible to treat the surface of Teflon with a monomolecular film of protein, which significantly enhances the wetting behavior. Thus, it is possible to modify the surface energy of fiber surfaces by appropriate lubricants/finishes to enhance liquid transport. The contact angle of polyethylene terephthalate (PET), Nylon 66, and polypropylene with water is 80°, 71°, and 108°, respectively. Thus, Nylon 66 is more wettable than PET. However, for polypropylene, the contact angle is >90°, and thus is nonwettable with water.

The second property of fundamental importance to the phenomena of liquid transport is surface tension of the liquid.

The third property of fundamental importance to the phenomena of liquid transport is the geometry of the solid surface. Although it is known that grooves enhance fluid transport in general, we have discovered particular geometries and arrangements of deep and narrow grooves on fibers and treatments thereof which allow for the spontaneous surface transport of aqueous fluids in single fibers. Thus we have discovered fibers with a combination of properties wherein an individual fiber is capable of spontaneously transporting water on its surface.

Geometry of the fiber surface and application of a hydrophilic lubricant are very important. Also, the particular geometry of the deep and narrow grooves is very important. For example, as shown in FIGS. 31A, 31B and 31C, grooves which have the feature that the width of the groove at any depth is equal to or less than the width of the groove at the mouth of the groove are preferred over those grooves which do not meet this criterion (e.g., grooves as shown in FIGS. 32A, 32B and 32C). If the preferred groove is not achieved, "bridging" of the liquid across the restriction is possible and thereby the effective wetted perimeter (Pw) is reduced. Accordingly, it is preferred that Pw is substantially equal to the geometric perimeter.

The number of continuous grooves present in the fiber useful in the present invention is not critical as long as the required geometry is present (i.e., the fiber satisfies the equation $(1-X \cos \theta_a) < -0.7$); or $(1-X \cos \theta_a) < 0$) with the proviso that the fiber is not an X-shaped or an H-shaped fiber having a $\theta_a$ of about 22 degrees, $\cos \theta_a$ of about 0.9, and an X factor of about 1.8; or $(1-X \cos \theta_a) < 0$ wherein the uphill flux value of said fiber is from about 2 to about 60 cc/g/hr when measured from a reservoir of synthetic urine test fluid along a 20 cm long ramp to an absorbant on an attached platform at 10 cm height. The term "about" is defined for the purposes of this equation as being within plus or minus 5% experimental error. Typically there are at least 2 grooves present, and preferably less than 10.

"Spontaneously transportable" and derivative terms thereof, such as "spontaneously wettable", refer to the behavior of a fluid in general and in particular a drop of fluid, typically water, when it is brought into contact with a single fiber such that the drop spreads along the fiber. Such behavior is contrasted with the normal behavior of the drop which forms a static ellipsoidal shape with a unique contact angle at the intersection of the liquid and the solid fiber. It is obvious that the formation of the ellipsoidal drop takes a very short time but remains stationary thereafter. FIGS. 1A–1C and 2A–2C illustrate the fundamental difference in these two behaviors. Particularly, FIGS. 2A, 2B, and 2C illustrate spontaneous fluid transport on a fiber surface. The key factor is the movement of the location of the air, liquid, solid interface with time. If such interface moves just after contact of the liquid with the fiber, then the fiber is spontaneously transportable; if such interface is stationary, the fiber is not spontaneously transportable. The spontaneously transportable phenomenon is easily visible to the naked eye for large filaments (>20 denier per filament (dpf)) but a microscope may be necessary to view the fibers if they are less than 20 dpf. Colored fluids are more easily seen but the spontaneously transportable phenomenon is not dependent on the color. It is possible to have sections of the circumference of the fiber on which the fluid moves faster than other sections. In such case the air, liquid, solid interface actually extends over a length of the fiber. Thus, such fibers are also spontaneously transportable in that the air, liquid, solid interface is moving as opposed to stationary.

Spontaneous transportability is basically a surface phenomenon; that is the movement of the fluid occurs on the surface of the fiber. However, it is possible and may in some cases be desirable to have the spontaneously transportable phenomenon occur in conjunction with absorption of the fluid into the fiber. The behavior visible to the naked eye will depend on the relative rate of absorption rs. spontaneous transportability. For example, if the relative rate of absorption is large such that most of the fluid is absorbed into the fiber, the liquid drop will disappear with very little movement of the air, liquid, solid interface along the fiber surface whereas if the rate of absorption is small compared to the rate of spontaneous transportability the observed behavior will be like that depicted in FIGS. 2A through 2C. In FIG. 2A, a drop of aqueous fluid is just placed on the fiber (time=0). In FIG. 2B, a time interval has elapsed (time=$t_1$) and the fluid starts to be spontaneously transported. In FIG. 2C, a second time interval has passed (time=$t_2$) and the fluid has been spontaneously transported along the fiber surface further than at time=$t_1$.

The fibers useful in the invention preferably have excellent uphill flux. Uphill flux is an index of the rate of transport of a fluid and is determined by the methodology described in Example 5 hereof. Uphill flux is related to adhesion tension. Adhesion tension is the product of the surface tension $\gamma$ and $\cos \theta_a$. We have surprisingly found that the type of fiber surface treatment can have a substantial impact on the effective adhesion tension (and therefore on the uphill flux). That is, we have found that certain surface treatments have the undesirable feature of reducing the effective surface tension of aqueous fluids (e.g., urine) such that it is substantially reduced from its theoretical potential. Thus, preferred surface treatments are those which result in the effective adhesion tension of the fluid to be transported to be as close to the theoretical adhesion tension as possible. The effective adhesion tension is measured by the method described in Example 6 hereof using the appropriate fluid. Preferred fibers useful in the invention have an effective adhesion tension in water of greater than 38 dynes/cm. More preferred is greater than 45 dynes/cm. Plasma treatment is a preferred surface treatment since the effective adhesion tension is close to the theoretical adhesion tension. It is not desired to be bound by any particular theory or mechanism; however, it is believed that for some surface treatments, such as use of potassium lauryl phosphate and/or PEG 600 monolaurate, a portion of the deposited surface treatment material partially solubilizes in the fluid, at least at the fluid/surface interface, substantially reducing the surface tension of the liquid, thereby reducing the effective adhesion tension but not substantially affecting the contact angle ($\theta_a$).

The fiber useful in the present invention can be crimped in any fashion known in the art such as stuffer box crimping.

It has also been discovered that for a given vertical distance and linear distance to move the fluid, a given channel depth and a given adhesion tension, there is an optimum channel width which maximizes the uphill flux of the liquid being transported.

Figure 17:
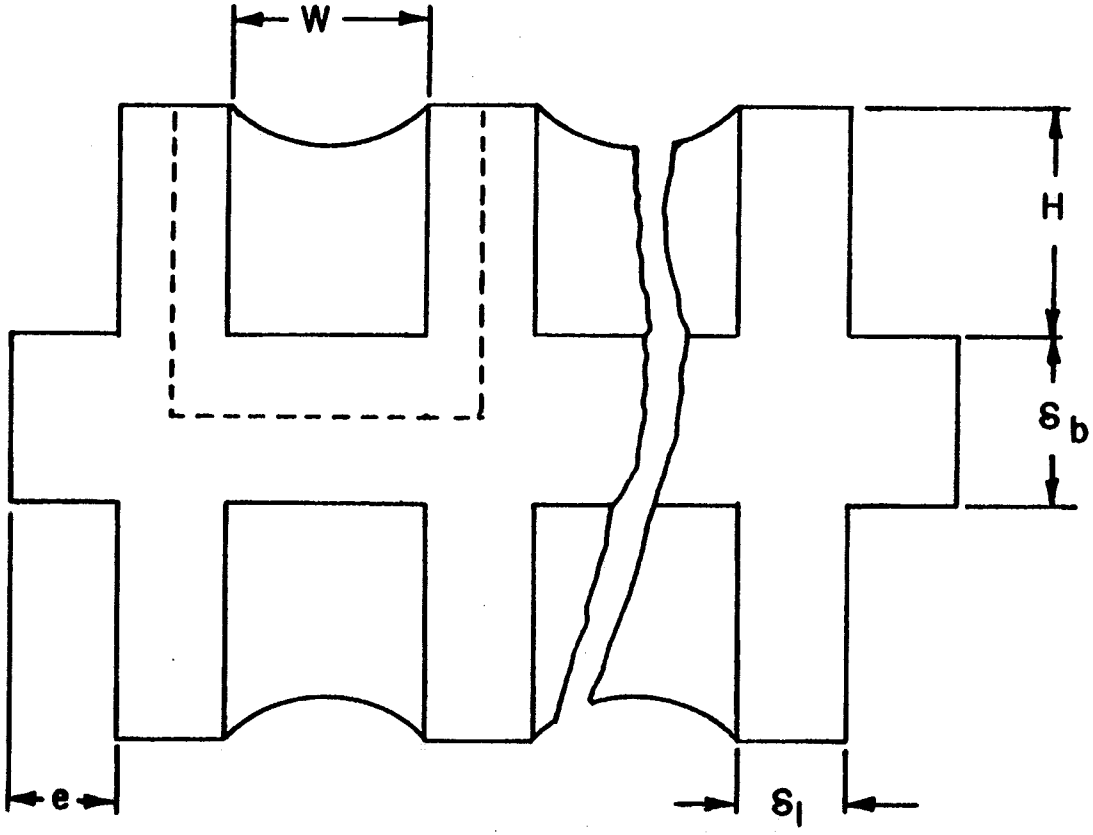
FIG. 17—a schematic representation depicting a unit cell.

A fiber useful in the invention can be characterized as having one or more "channels" or "unit cells". For example, the fiber cross-section shown in FIG. 17 depicts a unit cell. A unit cell is the smallest effective transporting unit contained within a fiber. For fibers with all grooves identical, the total fiber is the sum of all unit cells. In FIG. 17 each unit cell has a height, H, and a width, W. $S_l$ is the leg thickness and $S_b$ is the backbone thickness. In addition to the specific dimensions of W and H, the other dimensional parameters of the cross-section are important for obtaining the desired type of spontaneous transportability. For example, it has been found that the number of channels and the thickness of the areas between unit cells, among other things, are important for optimizing the uphill flux value of the fiber.

A fiber useful in the present invention is capable of spontaneously transporting water on the surface thereof. Distilled water can be employed to test the spontaneous transportability phenomenon; however, it is often desirable to incorporate a minor amount of a colorant into the water to better visualize the spontaneous transport of the water, so long as the water with colorant behaves substantially the same as pure water under test conditions. We have found aqueous Syltint Poly Red® from Milliken Chemicals to be a useful solution to test the spontaneous transportability phenomenon. The Syltint Poly Red® solution can be used undiluted or diluted significantly, e.g., up to about 50× with water.

A preferred process for helically crimping the fibers useful in the present invention involves fibers having both a major and a minor axis of symmetry, wherein quenching by air occurs perpendicular to the major axis of the fiber. In particular, the process involves the following steps: extruding a conventional PET fiber forming polymer; passing the polymer through spinneret hole shapes; orienting said spinneret hole shapes to the cross-flow quench air so that quenching occurs perpendicular to the major axis of the fiber; controlling the quench air; applying hydrophilic lubricants; taking up the fibers at conventional speeds; drafting the fibers using conventional drafting (single steam stage in steam or two stage in water and steam); adding an additional amount of hydrophilic lubricant; and relaxing the drawn fibers in a heated chamber to develop the helical crimp.

The full development of the helical crimp in the fibers useful in the present invention is realized by relaxing the fibers in heat. The temperature of the heating step is above the $T_g$ of the fibers. Also, it appears that the helical crimp is formed due to differences in the orientation of the fiber across the diameter of the cross section. This difference in orientation is built into the fiber by following the steps listed in the process previously described. The higher the difference in orientation, the more likely that the filament will form a helical crimp.

It is also preferred that the number of crimps/inch in the fiber is greater than 4 and the crimp amplitude is less than 2 mm.

It is preferred that the fiber useful in the invention has a hydrophilic lubricant coated on the surface thereof. Particularly preferred hydrophilic lubricants which can be used to lubricate the fibers useful in this invention include the following:

(1) Lubricant (PM 13430) comprising 49% polyethylene glycol (PEG) 600 monolaurate, polyoxyethylene (13.64) monolaurate, 49% polyethylene glycol (PEG) 400 monolaurate, polyoxyethylene (9.09) monolaurate, and 2% of 35% active 4-cetyl-4-ethylmorpholinium ethosulfate (antistat);
(2) Hypermer A109 sold by ICI Americas, Inc., which is a modified polyester surfactant;
(3) Milease T sold by ICI Americas, Inc. which is a soil release agent comprising polyester, water, and other ingredients;
(4) Brij 35 sold by ICI Americas, Inc. which is a polyoxyethylene (23) lauryl ether;
(5) Brij 99 sold by ICI Americas, Inc. which is a polyoxyethylene (20) oleyl ether;
(6) G-1300 sold by ICI Americas, Inc. which is a polyoxyethylene glyceride ester, a nonionic surfactant;
(7) G-1350 sold by ICI Americas, Inc., a polyoxylene-polyoxypropylene sorbitan linoleic phthalic ester; and
(8) Lubricant (PM 13430) comprising 49% polyethylene glycol (PEG) 600 monolaurate, polyoxyethylene (13.64) monolaurate, 49% polyethylene glycol (PEG) 400 monolaurate, polyoxyethylene (9.09) monolaurate, 2% of 35% active 4-cetyl-4-ethylmorpholinium ethosulfate (antistat), and optionally a refrigerant.

It is more preferred that the polyester is poly(ethylene terephthalate) and said hydrophilic lubricant is a potassium lauryl phosphate based lubricant comprising about 70 weight percent poly-(ethylene glycol) 600 monolaurate which is uniformly applied at a level of at least about 0.05%, preferably at least 0.5%, by weight of the total fiber. The fibers may also be plasma treated.

Among the methods of applying lubricants to the fibers useful in the invention include those described in U.S. Ser. No. 07/734,840 entitled "Lubricant-Impregnated Fibers and Processes for the Preparation Thereof", by Neal, Bagrodia, et al, filed on Jul. 23, 1991, and incorporated herein by reference.

The fibers useful in the present invention can be comprised of any material known in the art capable of having a cross-section of the desired geometry and capable of being coated or treated so as to reduce the contact angle to an acceptable level. These generally include polyesters, polypropylene, polyethylene, a cellulose ester, and a nylon. Preferred materials for use in the present invention are polyesters.

The preferred polyester materials useful in the present invention are polyesters or copolyesters that are well known in the art and can be prepared using standard techniques, such as, by polymerizing dicarboxylic acids or esters thereof and glycols. The dicarboxylic acid compounds used in the production of polyesters and copolyesters are well known to those skilled in the art and illustratively include terephthalic acid, isophthalic acid, p,p'-diphenyldicarboxylic acid, p,p'-dicarboxydiphenylethane, p,p'dicarboxydiphenylhexane, p,p'-dicarboxydiphenyl ether, p,p'-dicarboxyphenoxyethane, and the like, and the dialkylesters thereof that contain from 1 to about 5 carbon atoms in the alkyl groups thereof.

Suitable aliphatic glycols for the production of polyesters and copolyesters are the acyclic and alicyclic aliphatic glycols having from 2 to 10 carbon atoms, especially those represented by the general formula $HO(CH_2)_pOH$, wherein p is an integer having a value of from 2 to about 10, such as ethylene glycol, trimethylene glycol, tetramethylene glycol, and pentamethylene glycol, decamethylene glycol, and the like.

Other known suitable aliphatic glycols include 1,4-cyclohexanedimethanol, 3-ethyl-1,5-pentanediol, 1,4-xylylene, glycol, 2,2,4,4-tetramethyl-1,3-cyclobutanediol, and the like. One can also have present a hydroxylcarboxyl compound such as 4,-hydroxybenzoic acid, 4-hydroxyethoxybenzoic acid, or any of the other hydroxylcarboxyl compounds known as useful to those skilled in the art.

It is also known that mixtures of the above dicarboxylic acid compounds or mixtures of the aliphatic glycols can be used and that a minor amount of the dicarboxylic acid component, generally up to about 10 mole percent, can be replaced by other acids or modifiers such as adipic acid, sebacic acid, or the esters thereof, or with modifiers that impart improved dyeability to the polymers. In addition one can also include pigments, delusterants or optical brighteners by the known procedures and in the known amounts.

The most preferred polyester for use in preparing the fibers of the present invention is poly(ethylene terephthalate) (PET).

Other materials that can be used to make the fibers of the present invention include polyamides such as a nylon, e.g., nylon 66 or nylon 6; polypropylene; polyethylene; and cellulose esters such as cellulose triacetate or cellulose diacetate.

A single fiber useful in the present invention preferably has a denier of between about 3 and about 1,000, more preferred is between about 10 and about 70.

Fiber shape and fiber/fluid interface variables can be manipulated to increase fluid transport rate per unit weight of fiber (flux) by accomplishing the following:

(a) using less polymer by making the fiber cross-sectional area smaller (thinner legs, walls, backbones, etc., which form the channeled structure);
(b) moderately increasing channel depth-to-width ratio;
(c) changing (increasing or decreasing) channel width to the optimum width, and
(d) increasing adhesion tension, $\alpha \cos \theta$, at the channel wall by the proper selection of a lubricant for the fiber surface (which results primarily in a decrease in the contact angle at the wall without a significant lowering of the fluid surface tension at the wall).

The fibers useful in the present invention preferably have a surface treatment applied thereto. Such surface treatment may or may not be critical to obtain the required spontaneous transportability property. The nature and criticality of such surface treatment for any given fiber can be determined by a skilled artisan through routine experimentation using techniques known in the art and/or disclosed herein. A preferred surface treatment is a coating of a hydrophilic lubricant on the surface of the fiber. Such coating is typically uniformly applied at about a level of at least 0.05 weight percent, with about 0.1 to about 2 weight percent being preferred.

Preferred hydrophilic lubricants include polyoxyethylene (23) lauryl ether, polyoxyethylene (20) oleyl ether, polyoxylene-polyoxypropylene-sorbitan linoleic phthalic ester, Milease T, and a potassium lauryl phosphate based lubricant comprising about 70 weight percent poly-(ethylene glycol) 600 monolaurate. Many surfactants provide very good wetting of surfaces by lowering fluid surface tension and decreasing contact angle and thereby yield low adhesion tension at the surface. Therefore, it is important that the surfactant possess some attraction for the polyester surface (hydrophobic) and also for water (hydrophilic). It is also preferred that the surfactant bind tightly to the polyester surface and at the same time present high hydrophilicity to the water side of the interface. Another surface treatment is to subject the fibers to oxygen plasma treatment, as taught in, for example, *Plastics Finishing and Decoration,* Chapter 4, Ed. Don Satas, Van Nostrand Reinhold Company (1986).

The spinnerets useful to produce the fibers of the present invention must have a specific geometry in order to produce fibers that will spontaneously transport aqueous fluids.

Figure 3:
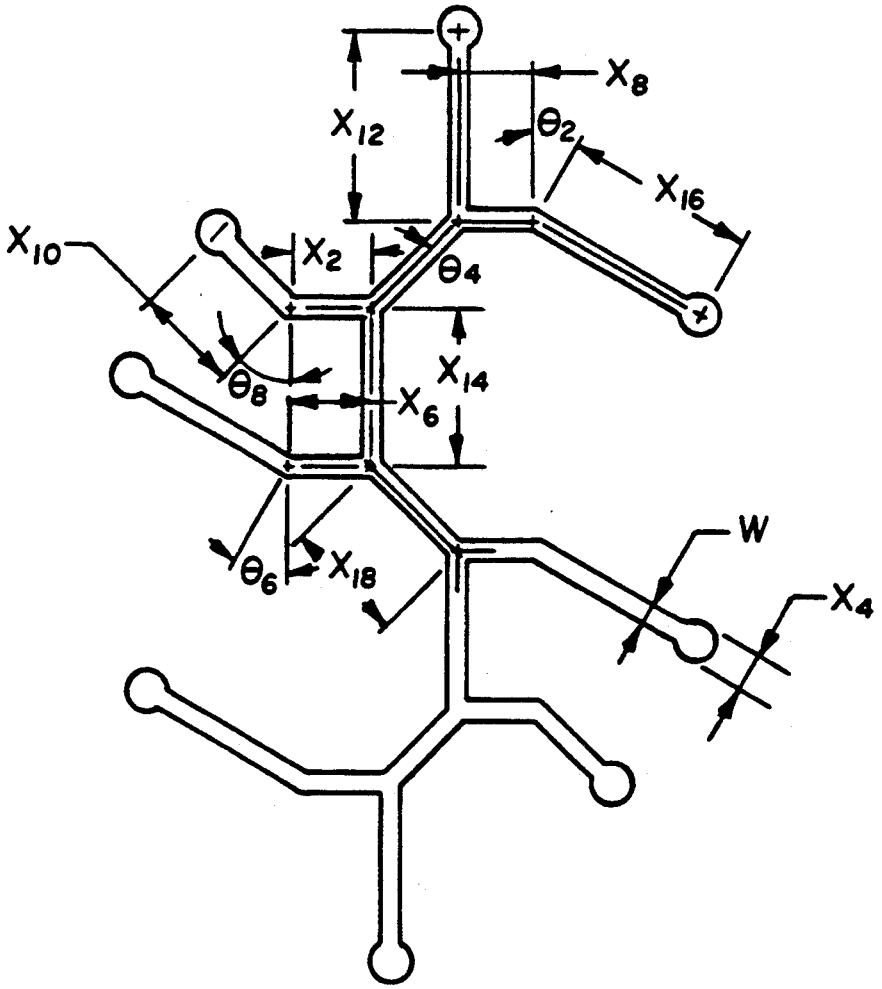
FIG. 3—schematic representation of an orifice of a spinneret useful for producing a spontaneously transportable fiber.

In FIG. 3, $W$ is between 0.064 millimeters (mm) and 0.12 mm.

$X_2$ is $4W^{+4W}_{-1W}$; $X_4$ is $2W \pm 0.5W$; $X_6$ is $6W^{+4W}_{-2W}$; $X_8$ is $6W^{+5W}_{-2W}$;

$X_{10}$ is $7W^{+5W}_{-2W}$; $X_{12}$ is $9W^{+5W}_{-1W}$; $X_{14}$ is $10W^{+5W}_{-2W}$;

$X_{16}$ is $11W^{+5W}_{-2W}$; $X_{18}$ is $6W^{+5W}_{-2W}$; $\theta_2$ is $30° \pm 30°$;

$\theta_4$ is $45° \pm 45°$; $\theta_6$ is $30° \pm 30°$; and $\theta_8$ is $45° \pm 45°$.

Figure 4:
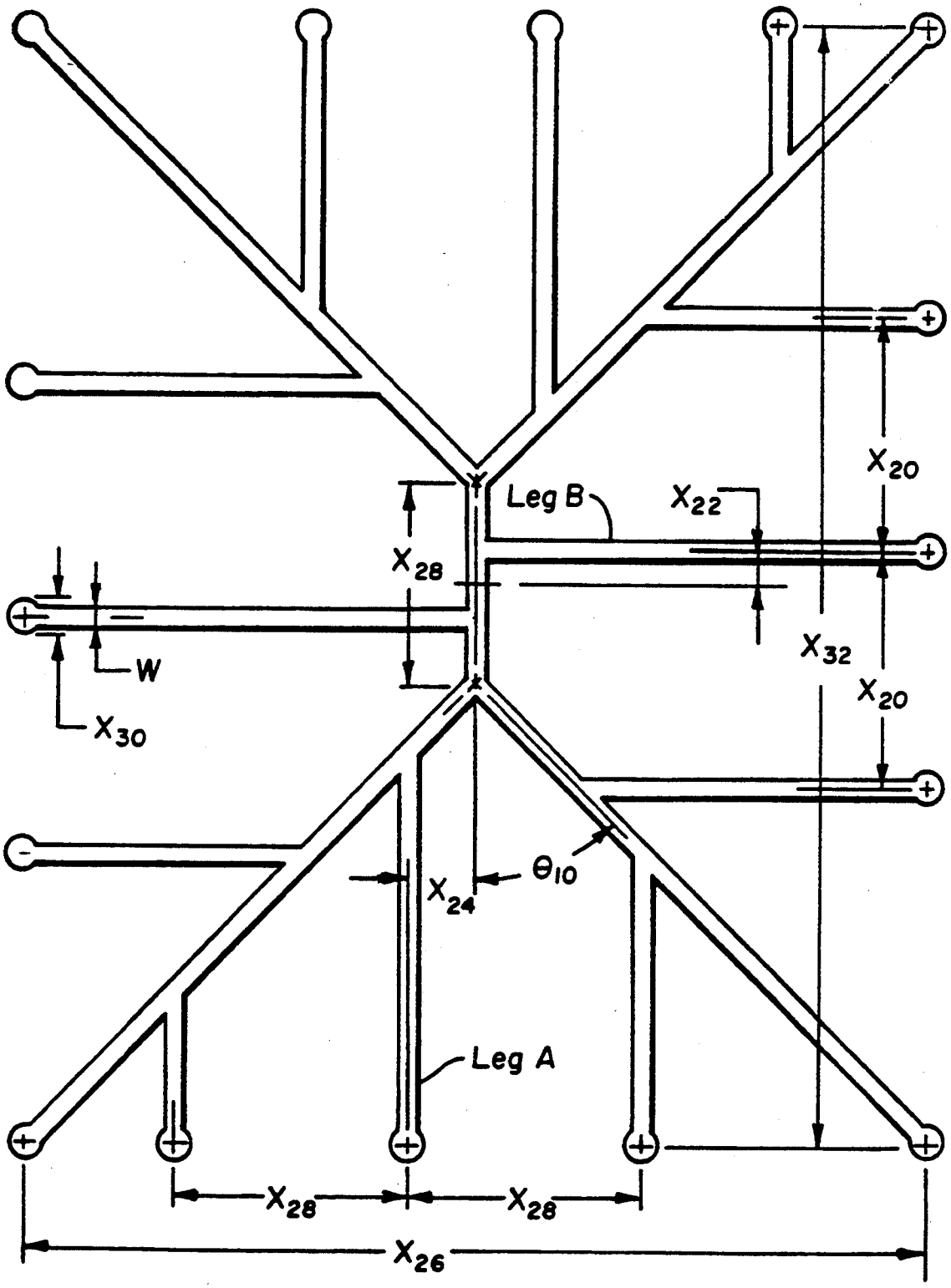
FIG. 4—schematic representation of an orifice of a spinneret useful for producing a spontaneously transportable fiber.

In FIG. 4, $W$ is between 0.064 mm and 0.12 mm;

$X_{20}$ is $17W^{+5W}_{-2W}$; $X_{22}$ is $3W \pm W$; $X_{24}$ is $4W \pm 2W$;

$X_{26}$ is $60W^{+8W}_{-4W}$; $X_{28}$ is $17W^{+5W}_{-2W}$; $X_{30}$ is $2W \pm 0.5W$;

$X_{32}$ is $72W^{+10W}_{-5W}$; and $\theta_{10}$ is $45° \pm 15°$. In addition, each Leg $B$ can vary in length from 0 to $\frac{X_{26}}{2}$; and each Leg $A$ can vary in length from 0 to $\tan(90 - \theta_{10})\left[\frac{X_{26}}{2} - X_{24}\right]$.

Figure 5:
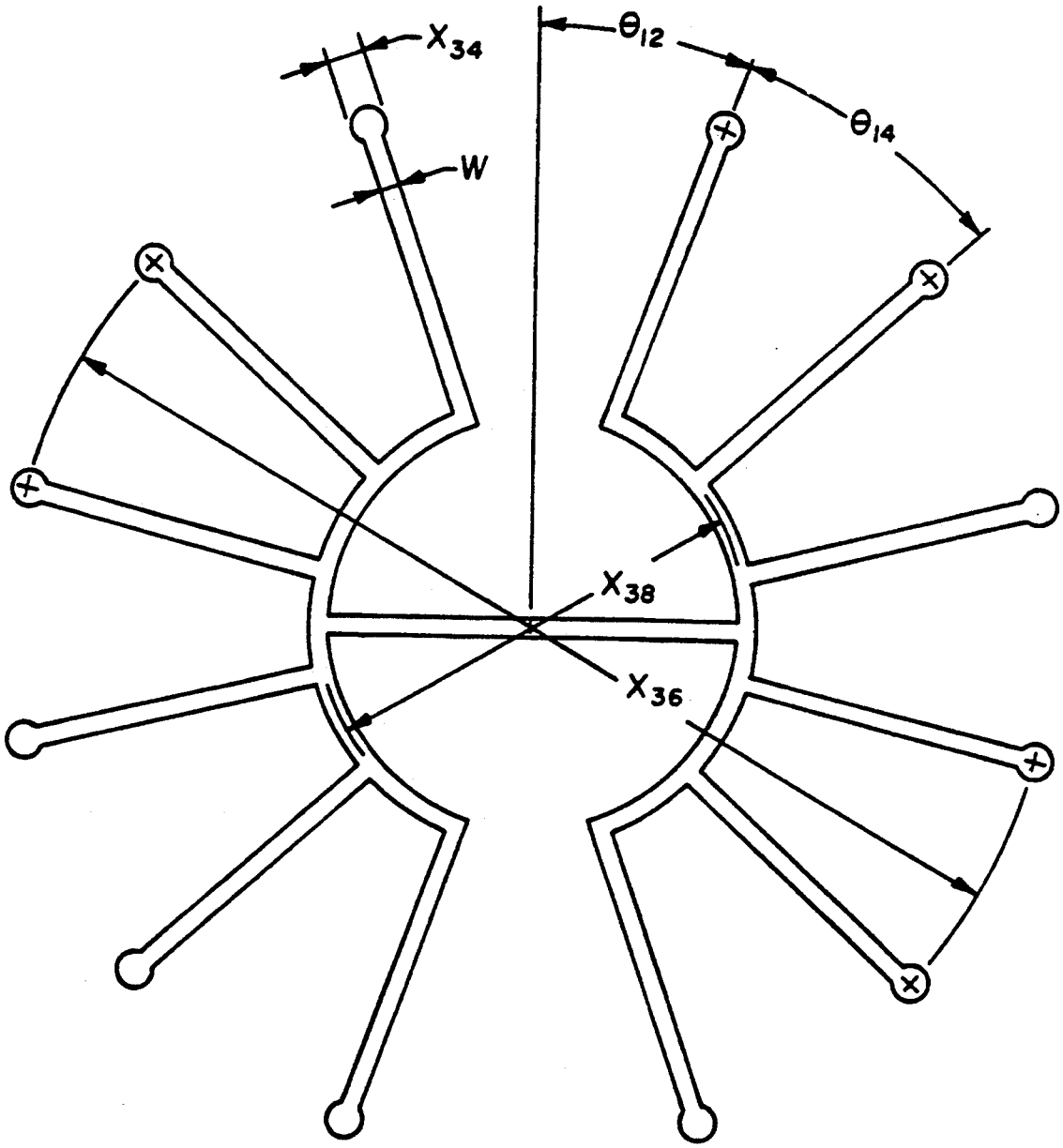
FIG. 5—schematic representation of an orifice of a spinneret useful for producing a spontaneously transportable fiber.

In FIG. 5, $W$ is between 0.064 mm and 0.12 mm;

$X_{34}$ is $2W \pm 0.5W$; $X_{36}$ is $58W^{+20W}_{-10W}$; $X_{38}$ is $24W^{+20W}_{-6W}$;

$\theta_{12}$ is $20°^{+15°}_{-10°}$; $\theta_{14}$ is $\frac{180° - 2\theta_{12}}{n - 1}$; and $n$ = number of legs per 180° = 2 to 6.

Figure 6:
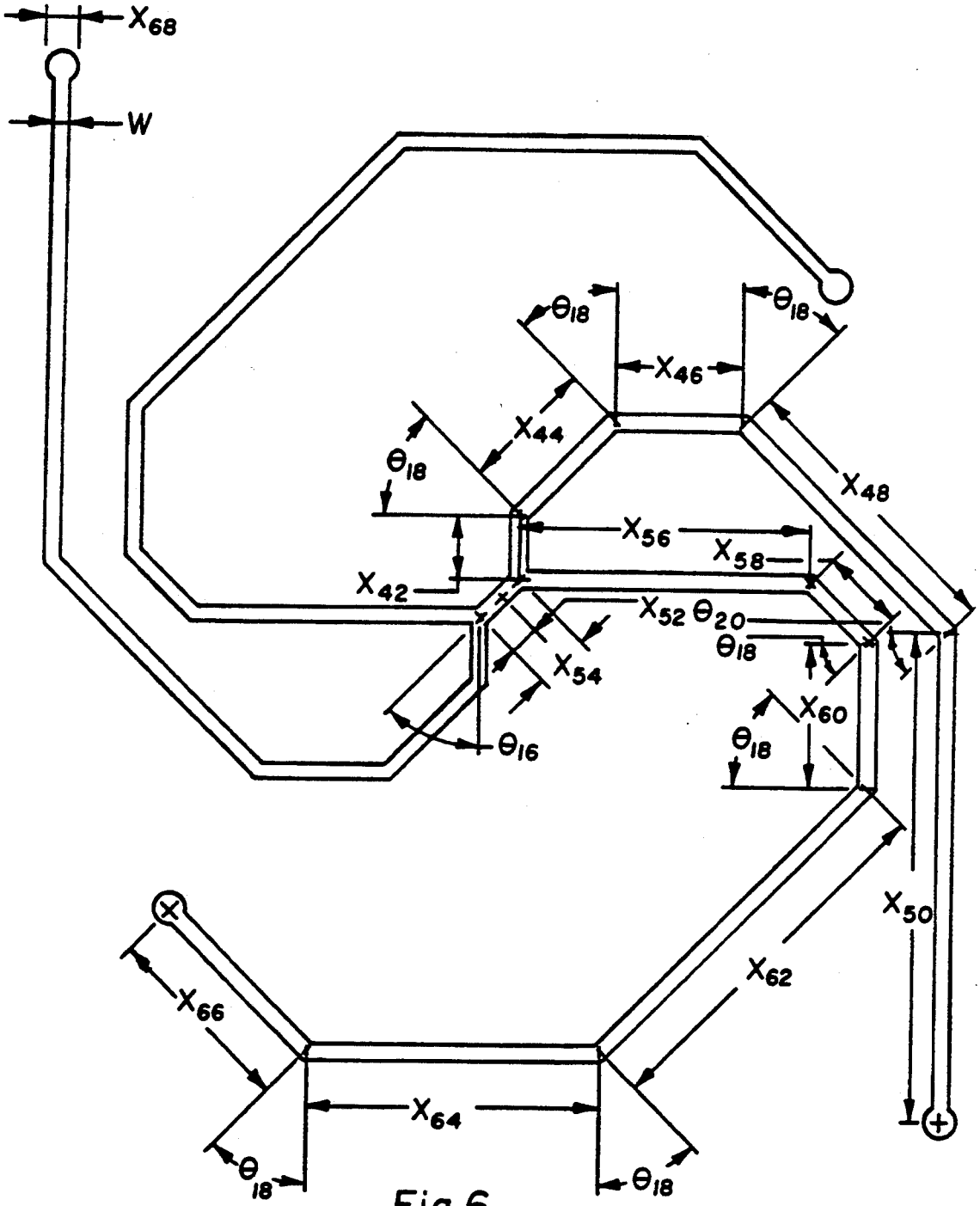
FIG. 6—schematic representation of an orifice of a spinneret useful for producing a spontaneously transportable fiber.

In FIG. 6, $W$ is between 0.064 mm and 0.12 mm;

$X_{42}$ is $6W^{+4W}_{-2W}$; $X_{44}$ is $11W \pm 5W$; $X_{46}$ is $11W \pm 5W$;

$X_{48}$ is $24W \pm 10W$; $X_{50}$ is $38W \pm 13W$; $X_{52}$ is $3W^{+3W}_{-1W}$;

$X_{54}$ is $6W^{+6W}_{-2W}$; $X_{56}$ is $11W \pm 5W$; $X_{58}$ is $7W \pm 5W$;

$X_{60}$ is $17W \pm 7W$; $X_{62}$ is $28W \pm 11W$; $X_{64}$ is $24W \pm 10W$;

$X_{66}$ is $17W \pm 7W$; $X_{68}$ is $2W \pm 0.5W$; $\theta_{16}$ is $45°^{+30°}_{-15°}$;

$\theta_{18}$ is $45° \pm 15°$; and $\theta_{20}$ is $45° \pm 15°$.

Figure 6B:
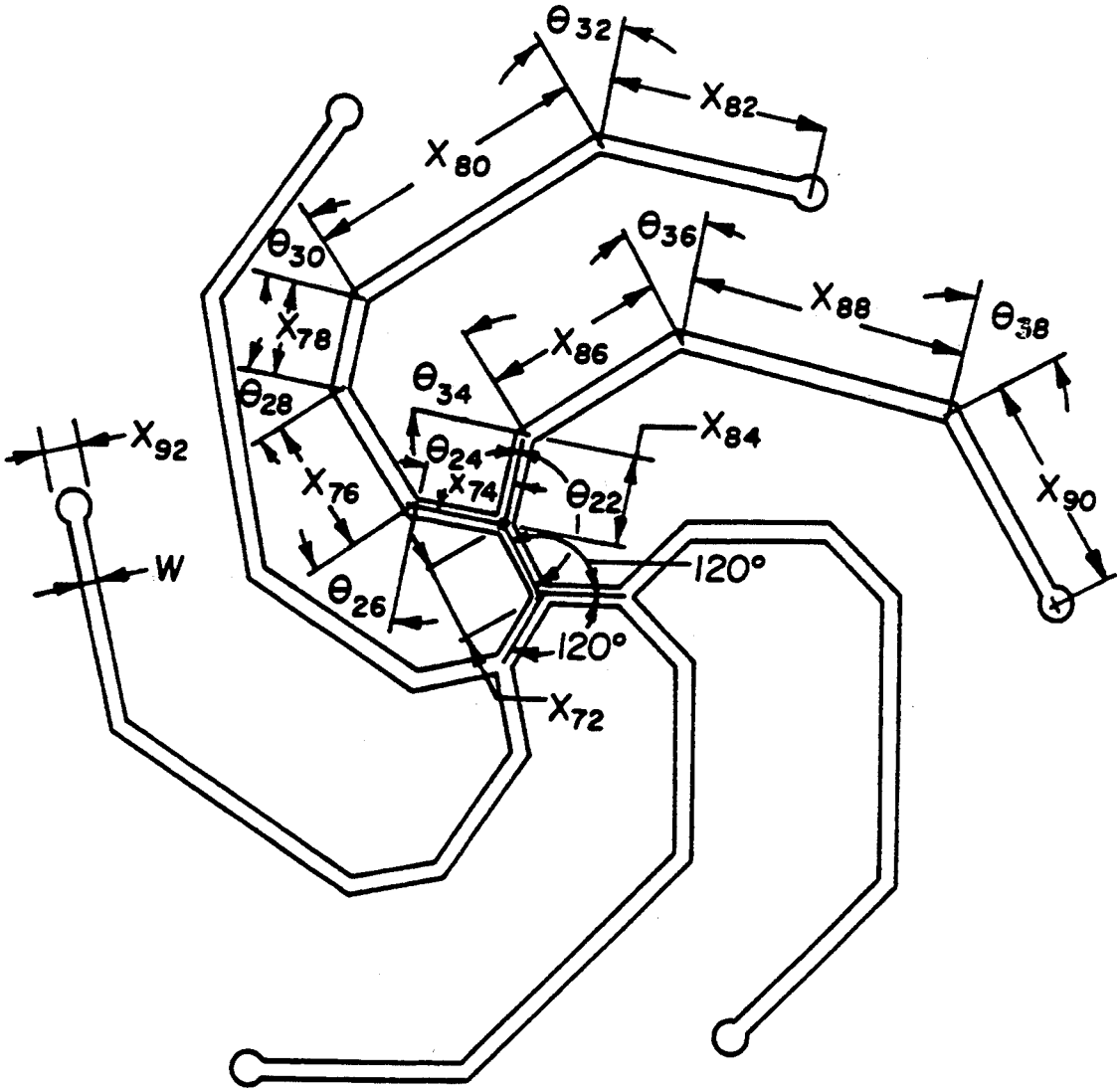
FIG. 6B—schematic representation of an orifice of a spinneret useful for producing a spontaneously transportable fiber.

In FIG. 6B, $W$ is between 0.064 mm and 0.12 mm, $X_{72}$ is $8W^{+4W}_{-2W}$; $X_{74}$ is $8W^{+4W}_{-2W}$; $X_{76}$ is $12W \pm 4W$;

$X_{78}$ is $8W \pm 4W$; $X_{80}$ is $24W \pm 12W$; $X_{82}$ is $18W \pm 6W$;

$X_{84}$ is $8W^{+4W}_{-2W}$; $X_{86}$ is $16W \pm 6W$, $X_{88}$ is $24W \pm 12W$, $X_{90}$ is $18W \pm 6W$, $X_{92}$ is $2W \pm 0.5W$, $\theta_{22}$ is $135° \pm 30°$, $\theta_{24}$ is $90° \pm {}^{45°}_{30°}$, $\theta_{26}$ is $45° \pm 15°$, $\theta_{28}$ is $45° \pm 15°$, $\theta_{30}$ is $45° \pm 15°$, $\theta_{32}$ is $45° \pm 15°$, $\theta_{34}$ is $45° \pm 15°$, $\theta_{36}$ is $45° \pm 15°$, and $\theta_{38}$ is $45° \pm 15°$.

Figure 7:
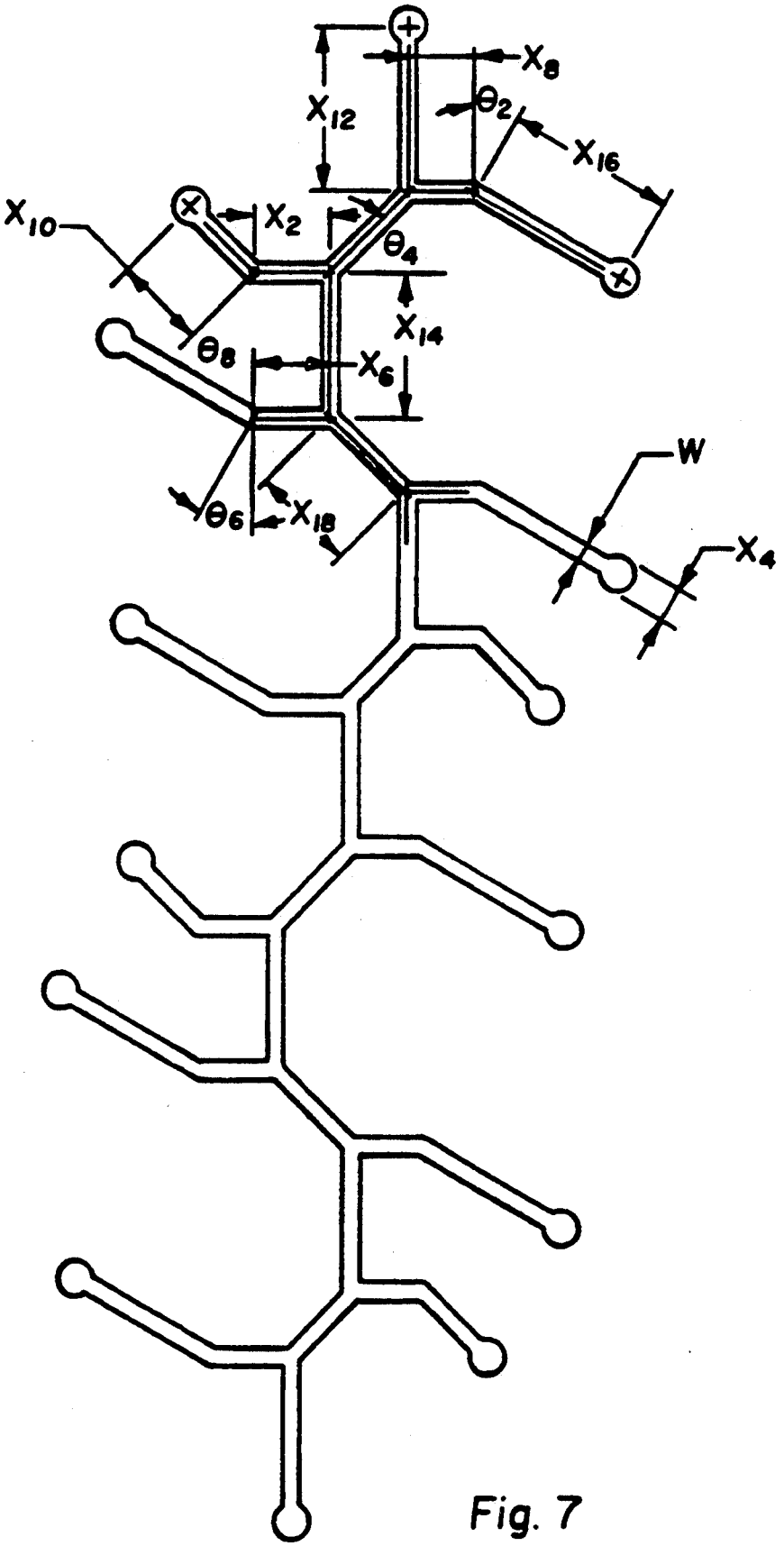
FIG. 7—schematic representation of an orifice of a spinneret having 2 repeating units, joined end to end, of the orifice as shown in FIG. 3.
Figure 8:
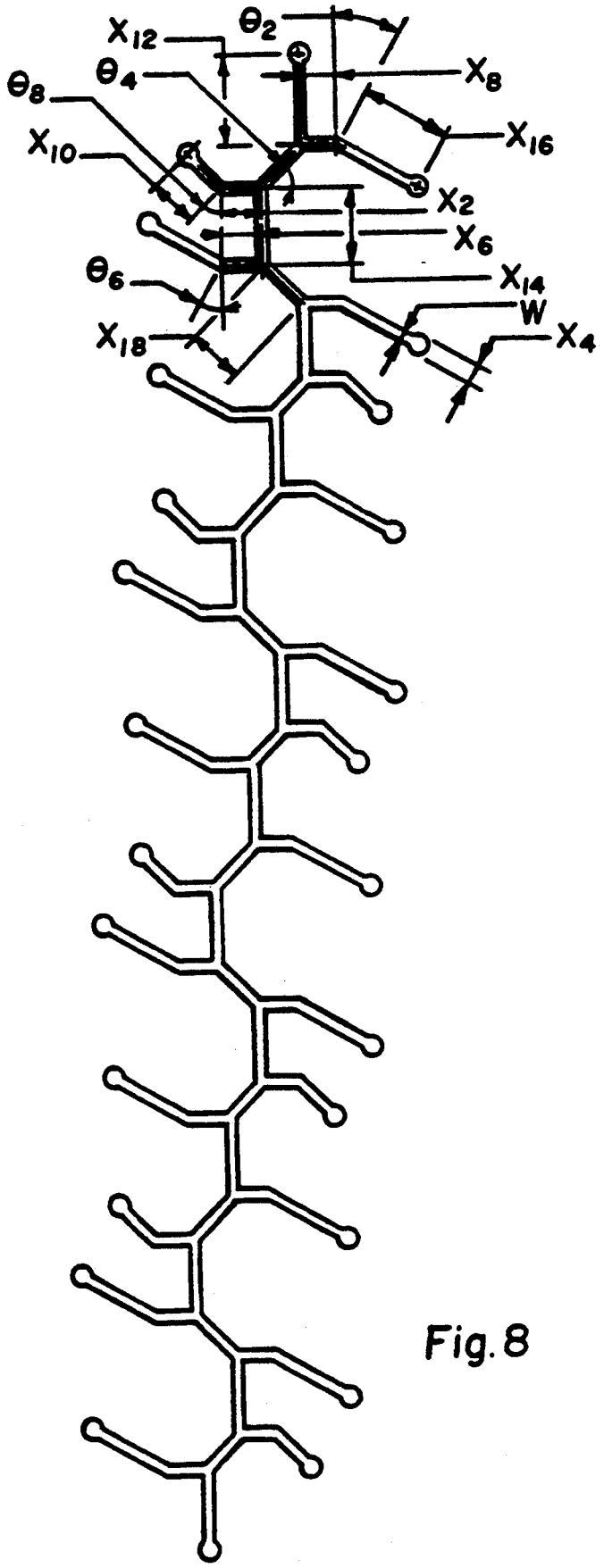
FIG. 8—schematic representation of an orifice of a spinneret having 4 repeating units, joined end to end, of the orifice as shown in FIG. 3.

In FIG. 7, the depicted spinneret orifice contains two repeat units of the spinneret orifice depicted in FIG. 3, therefore, the same dimensions for FIG. 3 apply to FIG. 7. Likewise, in FIG. 8, the depicted spinneret orifice contains four repeat units of the spinneret orifice depicted in FIG. 3, therefore, the same dimension for FIG. 3 applies to FIG. 8.

Figure 15:
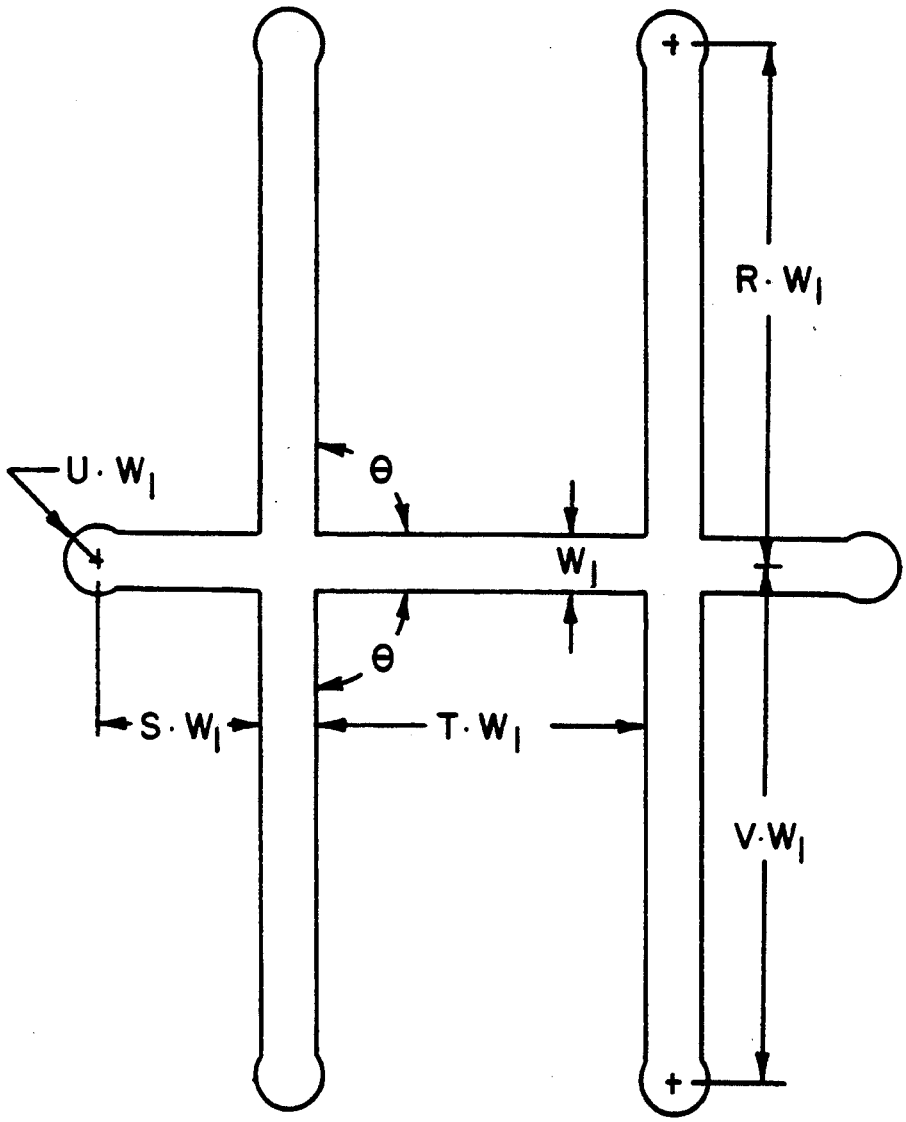
FIG. 15—a schematic representation of a preferred "H" shape orifice of a spinneret useful for producing a spontaneously transportable fiber.

FIG. 15 depicts a preferred "H" shape spinneret orifice of the invention. In FIG. 15, $W_1$ is between 60 and 150 $\mu$, $\theta$ is between 80° and 120°, S is between 1 and 20, R is between 10 and 100, T is between 10 and 300, U is between 1 and 25, and V is between 10 and 100. In FIG. 15, it is more preferred that $W_1$ is between 65 and 100$\mu$, $\theta$ is between 90° and 110°, S is between 5 and 10, R is between 30 and 75, T is between 30 and 80, U is between 1.5 and 2, and V is between 30 and 75.

Figure 16:
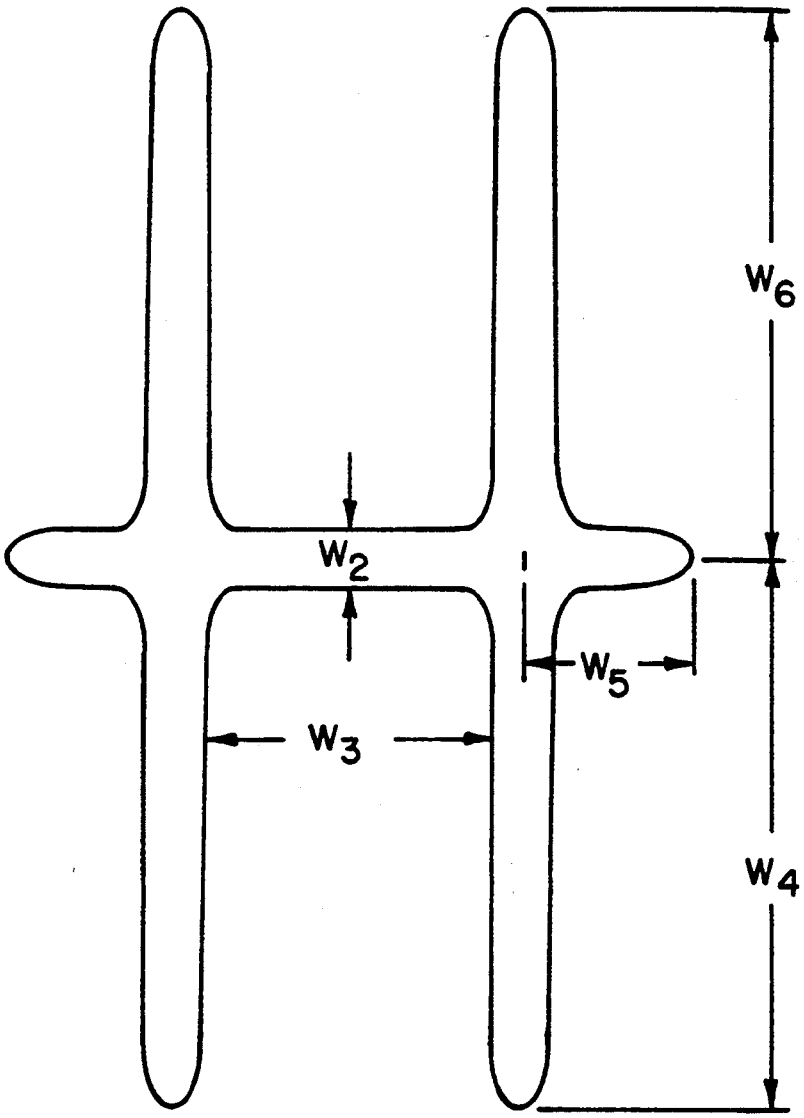
FIG. 16—a schematic representation of a poly-(ethylene terephthalate) fiber cross-section made using a spinneret having an orifice as illustrated in FIG. 15.

FIG. 16 depicts a poly(ethylene terephthalate fiber cross-section made from the spinneret orifice of FIG. 15. In FIG. 16, $W_2$ is less than 20 $\mu$, $W_3$ is between 10 and 300 $\mu$, $W_4$ is between 20 and 200 $\mu$, $W_5$ is between 5 and 50 $\mu$, and $W_6$ is between 20 and 200 $\mu$. In FIG. 16, it is more preferred that $W_2$ is less than 10 $\mu$, $W_3$ is between 20 and 100 $\mu$, $W_4$ is between 20 and 100 $\mu$, and $W_5$ is between 5 and 20 $\mu$.

Figure 12:
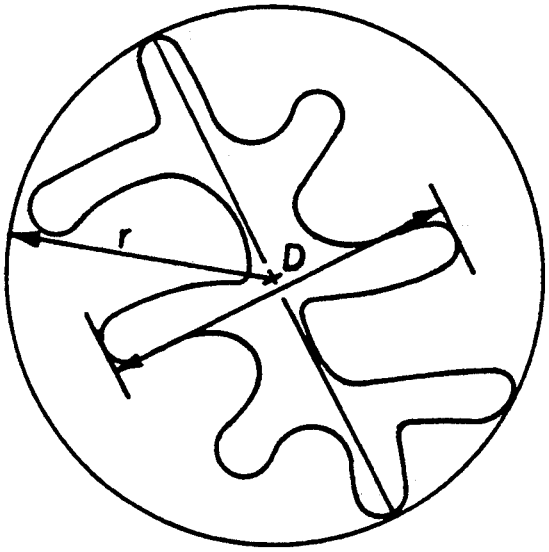
FIG. 12—schematic representation of a fiber cross-section made using a spinneret having an orifice as illustrated in FIG. 3 (Example 1). Exemplified is a typical means of determining the shape factor X.
Figure 13A:
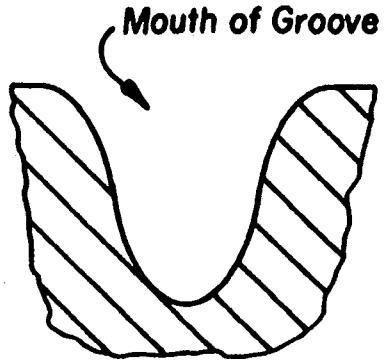
FIG. 13A—a schematic representation of a desirable groove in a fiber cross-section.
Figure 13B:
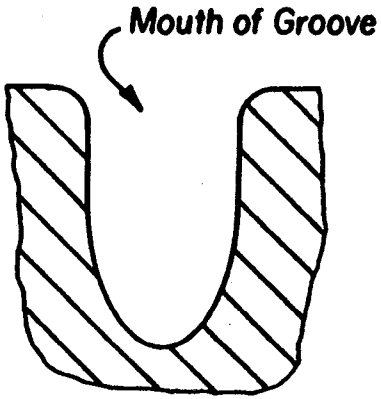
Figure 13C:
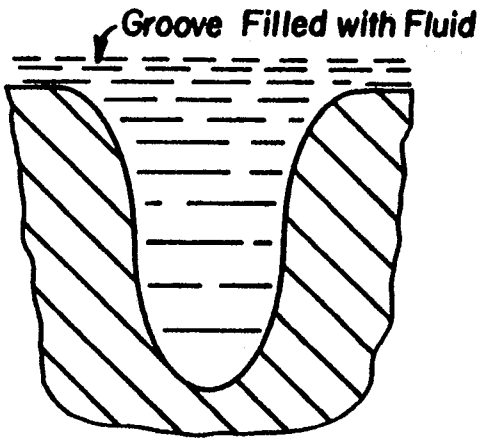
Figure 14A:
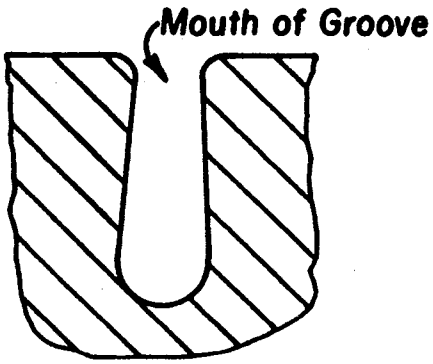
FIG. 14A—a schematic representation of a groove where bridging is possible in the fiber cross-section.
Figure 14B:
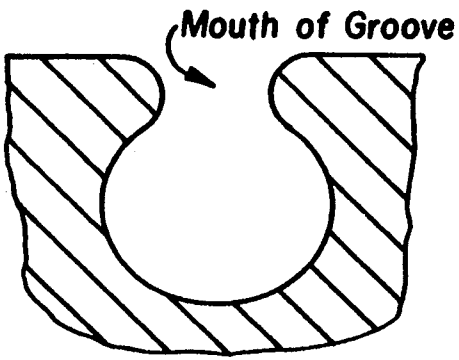
Figure 14C:
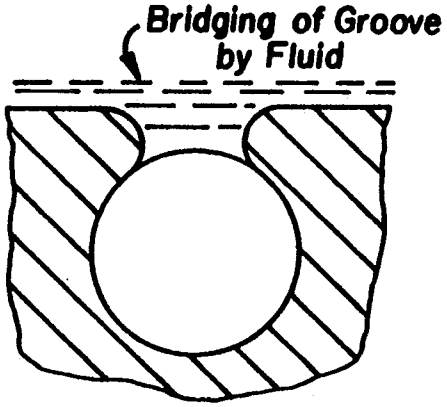

FIG. 12 illustrates the method for determining the shape factor, X, of the fiber cross-section. In FIG. 12, r=37.5 mm, $P_w$=355.1 mm, D=49.6 mm; thus, for the fiber cross-section of FIG. 12:

$$X = \frac{355.1}{4 \times 37.5 + (\pi - 2)\,49.6} = 1.72.$$

The fibers of the present invention can be in the form of crimped or uncrimped tows or staple fibers comprising a plurality of the fibers of the present invention.

A feature of the invention is that the fibers may be colored with water-soluble colorants, washed out with water, preferably tap water or water with a temperature of room temperature, and recolored with water-soluble colorants. The pH of the tap water in the present invention need not be changed. The water need not be warm. No specialized dye is required. Any water-soluble colorant is useful within the context of this invention.

A toy is defined herein as a children's object of play as understood by a person of ordinary skill in the art, for example, dolls, stuffed animals, animal or human-like figurines, etc.

The fibers useful in this invention are preferably useful for a doll's hair. The doll's hair can be mounted to the toy article of manufacture in various ways including the form of a wig for demountable application to a doll's head or by permanently securing it to the doll's head.

The fibers useful in this invention may also be useful in other toy articles of manufacture including, but not limited to, yo-yo string.

Polyamide, polyvinyl chloride, polypropylene, polyacrylic, and polyester fibers are commonly used as materials for artificial hairs by either melt-spinning or wet-spinning methods, for example in dolls or wigs.

However, the fibers used as artificial hairs require certain characteristics, i.e., features peculiar to hair, such as gloss, color, strength, weathering resistance, as well as curling properties, combing properties, and the like.

The type of surface colorants useful in this invention are "indicator" dyes. The terms "dye" and "surface colorant" are used interchangeably herein. In this invention the "surface colorant" or "dye" travels on the surface of the fibers useful in this invention. No heat is needed in the coloring process of this invention. Indicator dyes are commonly categorized by their functional ability to visually show, by a capacity for color change, the condition of a solution or product with respect to its relative acidity. An example of a classical use of an indicator dye detecting the end point of a titration. The broad grouping of materials that have been discovered and are currently being discovered which will function as indicators escape conventional chemical classification.

The present invention specifically comprehends the use of those products which historically have been classified as indicator dyes.

Many commercially available indicator dyes reasonably would fall within the application of the invention and may be employed on an empirical test basis to obtain hair coloring desired. Some examples of indicator dyes that may be utilized in the context of this invention are the following: methyl violet, crystal violet, ethyl violet, malachite green oxalate, methyl green, cresol red, quinaldine red, para methyl red, metanil yellow, thymol blue, meta creosol purple, eyrthrosin disodium salt, benzopurpurin 4 B, dinitro-phenol, congo red, methyl orange-xylene cyanole solution, methyl orange, ethyl orange, methoxybenzene-sulfonic acid, bromocreosol green, resazurin, ethyl red lacmoid, alizarin red, methyl red, propyl red, bromocresol purple, chlorophenol red, nitrophenol, bromothymol blue, dinitrobenzolyene urea, nitrophenol, bromothymol blue, dinitrobenzoylene urea, brilliant yellow, phenol red, neutral red, nitrophenol, curcumin, meta creosol purple, thymol blue, cresolphthalein, naphtholbenzein, phenolphthalein, thymalphthalein, alizarin yellow R.

The surface colorants preferably would be in solution form in concentrations sufficient so that the fibers used as the doll hair will be visibly and sufficiently surface colored with the surface colorant so that a color change will take place upon contact with the surface colorant. Solution concentrations are preferably such that the solution(s) will be non-toxic if accidentally swallowed. The solution concentration is preferably sufficient so that it is edible in nature. Examples of edible dyes include food coloring dyes which are commonly known in the art.

The surface colorants generally contain at least minor amounts of water. They can also contain alcohols such as isopropyl alcohol, isobutyl alcohol, and butyl alcohol.

The invention should preferably be consistent with children's play safety requirements and offers stability in the play environment consistent with a long toy service life.

This invention can be further illustrated by the following examples of preferred embodiments thereof, although it will be understood that these examples are included merely for purposes of illustration and are not intended to limit the scope of the invention unless otherwise specifically indicated. All percentages are by weight, unless otherwise specified.

EXAMPLES

Example 1 (Base Fiber Preparation)

Figure 9:
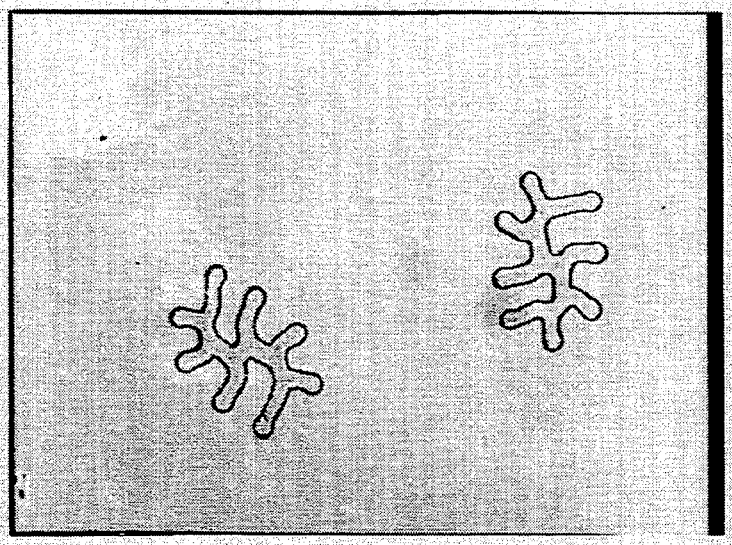
FIG. 9—photomicrograph of a poly(ethylene terephthalate) fiber cross-section made using a spinneret having an orifice as illustrated in FIG. 3 (specific dimensions of spinneret orifice described in Example 1).

Poly(ethylene terephthalate) (PET) polymer of 0.6 I.V. was used in this example. I.V. is the inherent viscosity as measured at 25° C. at a polymer concentration of 0.50 g/100 milliliters (mL) in a suitable solvent such as a mixture of 60% phenol and 40% tetrachloro-ethane by weight. The polymer was dried to a moisture level of ≦0.003 weight percent in a Patterson Conaform dryer at 120° C. for a period of 8 hours. The polymer was extruded at 283° C. through an Egan extruder, 1.5-inch diameter, with a length to diameter ratio of 28:1. The fiber was extruded through an eight orifice spinneret wherein each orifice is as shown in FIG. 3 wherein W is 0.084 mm, $X_2$ is 4 W, $X_4$ is 2 W, $X_6$ is 6 W, $X_8$ is 6 W, $X_{10}$ is 7 W, $X_{12}$ is 9 W, $X_{14}$ is 10 W, $X_{16}$ is 11 W, $X_{18}$ is 6 W, $\theta_2$ is 0°, $\theta_4$ is 45°, $\theta_6$ is 30°, and $\theta_8$ is 45°. The polymer throughput was about 7 pounds (lb)/hour. The air quench system has a cross-flow configuration. The quench air velocity at the top of the screen was an average of 294 feet (ft)/minute. At a distance of about 7 inches from the top of the screen the average velocity of the quench air was about 285 ft/minute, and at a distance of about 14 inches from the top of the screen the average quench air velocity was about 279 ft/minute. At about 21 inches from the top of the air screen the average air velocity was about 340 ft/minute. The rest of the screen was blocked. Spinning lubricant was applied via ceramic kiss rolls. The lubricant has a general composition as follows: it is a potassium lauryl phosphate (PLP) based lubricant having poly(ethylene glycol) 600 monolaurate (70% by weight) and polyoxyethylene (5) potassium lauryl phosphate (30% by weight). An emulsion of the above lubricant with water (90%) was used as the spinning lubricant. The lubricant level on the fiber samples was about 1.5%. Fibers of 20 dpf (denier per filament) were wound at 3,000 meters per minute (MPM) on a Barmag SW4SL winder. A photomicro-graph of a cross-section of this fiber is shown in FIG. 9 (150× magnification). The single fiber was tested for spontaneous surface transportation of an aqueous solution which was aqueous Syltint Poly Red ® (obtained from Milliken Chemicals) which is 80 weight % water and 20 weight % red colorant. The single fiber of 20 dpf spontaneously surface transported the above aqueous solution. The following denier per filament PET fibers were also made at different speeds as shown in Table I below:

TABLE I

| dpf | Spin Speed (MPM) | Winder |
|---|---|---|
| 20 | 3,000 | Barmag |
| 40 | 1,500 | Leesona |
| 60 | 1,000 | Leesona |
| 120 | 500 | Leesona |
| 240 | 225 | Leesona |
| 400 | 150 | Leesona |

All the single fibers of above PET fiber with the dpf of 20, 40, 60, 120, 240, and 400 spontaneously surface transported the aqueous solution of Syltint Poly Red ® liquid. The value of the "X" parameter (as defined hereinbefore) for these fibers was about 1.7. PET film of 0.02 inch thickness was compression molded from the same polymer as that used for making the above fiber. Contact angle of distilled water on the above film was measured in air with a contact angle goniometer. The contact angle was 71.7°. Another sample of the same film as above was sprayed with the same lubricant as used for making the fiber in this example at about 1.5% level. The contact angle of distilled water on the PET film sprayed with the lubricant was about 7°. Thus, the factor $(1-X \cos \theta)$ in this case is $(1-1.7(\cos 7°))=-0.69$, which is less than zero.

Example 2 (Base Fiber Preparation)

Figure 11:
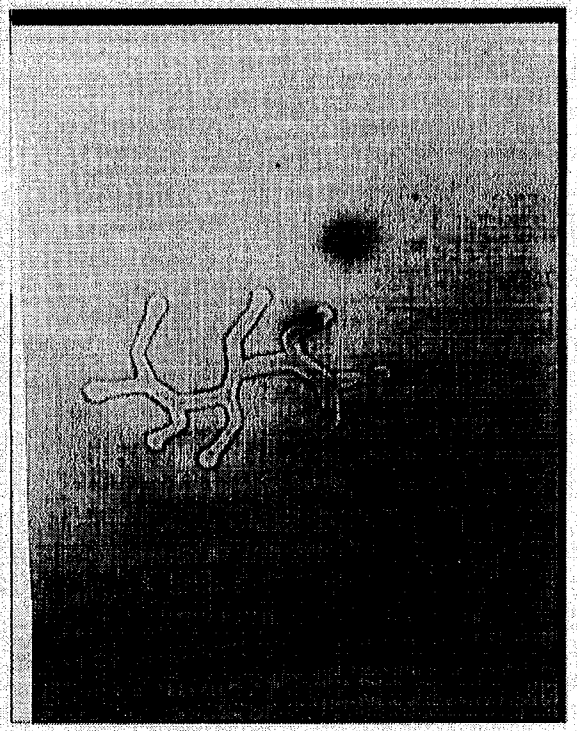
FIG. 11—photomicrograph of a nylon 66 fiber cross-section made using a spinneret having an orifice as illustrated in FIG. 3 (specific dimensions of spinneret orifice described in Example 2).

Polyhexamethylene adipamide (nylon 66) was obtained from Du Pont (Zytel ® 42). The polymer was extruded at 279° C. A spinneret as shown in FIG. 3 was used to form 46 dpf fiber at 255 meters/minute speed. The specific dimensions of the spinneret orifices were the same as described in Example 1 except that $\theta_2$ was 30° instead of 0°. The quenching conditions were the same as those for obtaining PET fiber as in Example 1. A photomicrograph of the fiber cross-section is shown in FIG. 11 (150× magnification)- The lubricant level on the fiber was about 1.8% by weight. The same lubricant as used in the PET fiber was used (Example 1). This Nylon 66 fiber spontaneously transported the aqueous Syltint Poly Red ® solution on the fiber surface. The value of the "X" parameter for this fiber was about 1.9. Nylon 66 film of 0.02 inch thickness was compression molded from the same polymer as that used for making the fiber of Example 2. Contact angle of distilled water on the above film was measured in air with a contact angle goniometer. The contact angle was 64°. Another sample of the same film as above was sprayed with the same lubricant as used for making the fiber in this example at about the 1.8% level. The contact angle of distilled water on the nylon 66 film sprayed with the lubricant was about 2°. Thus, the factor $(1-X \cos \theta)$ in this case is $(1-1.9(\cos 2°))=-0.9$, which is less than zero.

Example 3 (Base Fiber Preparation)

Figure 10:
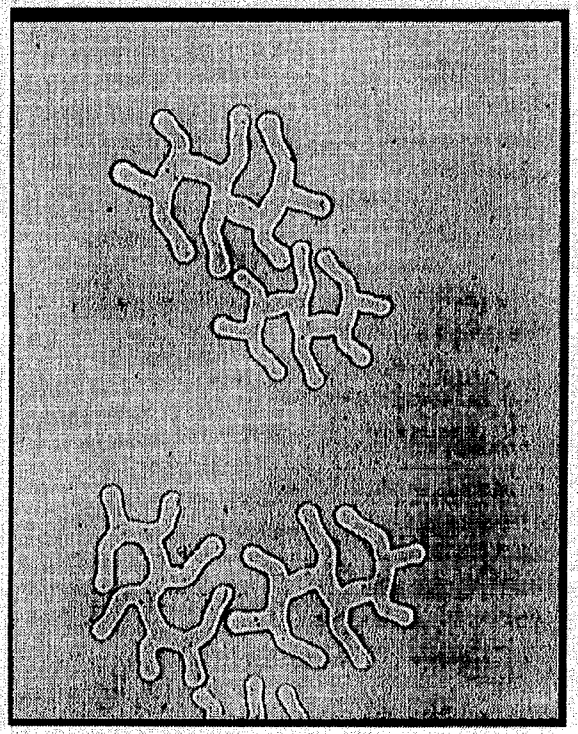
FIG. 10—photomicrograph of a polypropylene fiber cross-section made using a spinneret having an orifice as illustrated in FIG. 3 (specific dimensions of spinneret orifice described in Example 2).

Polypropylene polymer was obtained from Shell Company (Grade 5C14). It was extruded at 279° C. A spinneret as shown in FIG. 3 was used to form 51 dpf fiber at 2,000 MPM speed. The specific dimensions of the spinneret orifices were the same as in Example 2. The quenching conditions were the same as those for obtaining PET fiber. A photomicrograph of the fiber cross-section is shown in FIG. 10 (375× magnification). The lubricant level on the fiber was 2.6%. The same lubricant as used in PET fiber was used (Example 1). The polypropylene fiber spontaneously transported the aqueous Syltint Poly Red ® solution on the fiber surface. This spontaneously transportable phenomenon along the fiber surface was also observed for a 10 dpf, single polypropylene fiber. The value of the "X" parameter for this fiber was about 2.2. Polypropylene film of 0.02 inch thickness was compression molded from the same polymer as that used for making the above fiber of Example 3. Contact angle of distilled water on the above film was measured in air with a contact angle goniometer. The contact angle was about 110°. Another sample of the same film as above was sprayed with the same lubricant as used for making the fiber in this example at about the 2.6% level. The contact angle of distilled water on the polypropylene film sprayed with the lubricant was 12°. Thus, the factor $(1-X \cos \theta)$ in this case is $-1.1$, which is less than zero.

EXAMPLE 4 (Example of the Invention)

A tow of spontanously wettable fibers, prepared as in Example 1, about 3 inches long, having 50 denier per filament and a tow denier of about 5,000 was cut and used as "hairs" for a model doll. Ten milliliters of "red" food grade colorant was added to about 100 milliliters of water. The solution was mixed. The tow sample was attached to the model doll to represent its hairs. The hairs were dipped at one end (about ¼ inch in length of the doll's hair) in the "red" food grade colorant/water mixture. It was immediately observed that the red solution moved along the hairs. In about 300 seconds, the hairs turned red along the total length of the hairs. The hairs were then washed in tap water and the color was removed from the fibers. This process was repeated successfully with green food grade colorant.

Example 5—Uphill Flux Test Scope and Significance

This method is used to determine the fluid transport rate of capillary transport materials from a reservoir of synthetic urine fluid along an incline to an absorbant. This computer monitored version of the method automatically measures the fluid uptake of the test materials and provides a profile of the weight gain of the transport and absorbant storage materials with time. The spontaneous movement of the fluid up the incline and through the transport material is a quantitative measure of the surface and capillary forces acting on the fluid in opposition to gravity. Uphill transport testing provides a means of comparing rate differences due to the type and size of capillary transport materials as well as surface treatments and geometries. The test can also be used to evaluate the effects of test fluid surface tension as well as different absorbant materials. Finally, the test can be modified to simulate in-use conditions such as removing the reservoir and replacing it later to simulate multiple urine additions.

Summary of Method

The uphill transport test is used to determine the fluid transport rate of capillary transport materials from a reservoir of synthetic urine test fluid along a 20 cm long ramp to an absorbant on an attached platform at 10 cm height. Once the prepared specimen is mounted on the platform/incline, the operator initiates the test according to the instructions given by the computer program by placing the lower end of the transport material in the reservoir of fluid. The test continues for 90 minutes or until terminated by the operator.

Definitions

The terms employed in this method are commonly used in normal laboratory practice and require no special comment.

Safety Precautions

Normal safety precautions and safe handling practices should be observed.

Sources of Error

Fluid transport is very surface and geometry dependent. Surface contamination should be avoided and sample handling should be minimized.

Condition all fiber and fabric samples, including the storage or absorbant material, at least overnight in the laboratory before testing so that the moisture content is controlled by the relative humidity in the laboratory.

The balance is very sensitive to fluid movement in the two reservoirs. Because the fluid transported by the test specimen is the measured response of the test, an accurate tare weight of the fluid before the test is started is essential. The computer does not take this tare weight reading until the specimen to be tested has been identified to the computer and the label is accepted as correct by the operator. Therefore, prior to this time in the program, adjustments in the specimen or test apparatus can be made without affecting the results. All adjustments must be made prior to this point in the testing procedure.

Reagents and Materials

SYN-URINE test fluid from Jayco Pharmaceuticals (dyed with food coloring to aid observation)

Transport material of choice, in most cases this will be a sheet of PET filaments Absorbant or storage material, such as Bounty® towels or diaper core sections Calibration and Standardization Sample Preparation Weigh a quantity of transport material precut to 40 cm length. Pull out a 20 cm length of Saran Wrap from its 12-inch wide dispenser box. The 11 ½-inch wide roll of wrap is just the right size to place around the transport material from the bottom or back side to the top side with the ends of the wrap just meeting on the top for minimum overlap (⅛–¼ inch). Wrap loosely with Saran Wrap with about 5 cm of transport material sticking out from the end to be placed in the reservoir and with 15 cm sticking out from the end to be placed in the absorbant. The resulting area of transport material covered with wrap will be 20 cm length by 5 ½ inch width. This covering minimizes evaporation from the transport material between the reservoir and the absorbant. Cut the absorbant material of choice to 6 inch × 6 inch size.

Mount the covered transport material on the ramp with its previously assembled absorbant or assemble the transport material/absorbant layers on the ramp. Be sure the filled reservoir has been previously covered with stiff paper or cardboard so the 5 cm tail of the transport material will not enter the fluid until the computer has been set up and is ready to start the data collection process. Once the absorbant is in place on the horizontal part of the ramp, apply a load weight over the absorbant (usually 0.1 psi).

Procedure

After turning on the computer, note the test menu and the C> prompt. Type "date" and enter the current date [Return]. Type "UP" to start the test program. Follow the instructions on the computer screen. Stop after you have labeled the sample to be tested. Accepting the labeling as correct will cause the computer to read the balance, and this must not occur until the balance has stabilized with the test specimen and any weights completely in place.

The test is started once the balance is stable by removing the reservoir cover and allowing the transport material to enter the transport fluid. Press [Return] when this occurs to start the computer program that collects the weight data.

The computer program is designed so that two transport processes are followed. The first one is when the fluid moves up the incline of the ramp until the fluid front just reaches the absorbant at the top of the incline. This is the "induction" process. The computer must know when the fluid reaches the absorbant material. Pressing the F5 key tells the computer to calculate the induction process and to begin collecting data for the "transport" process that occurs as the fluid moves in the absorbant material at the top of the ramp.

At the end of the test (90 minutes total or sooner if the test is terminated by the operator) enter the weight of the transport material as requested by the computer. The computer calculates the appropriate times and flux values and puts the results on the printer. The computer is programmed in any conventional way to carry out these calculations.

Example 6—Measurement of Adhesion Tension

This describes the measurement of adhesion tension between a liquid and the surface of a polymer film. The adhesion tension at a solid-liquid-air interface is defined as the force per unit length of interface exerted on the solid surface in the plane of the surface and normal to the interface. The apparatus used here consists of a Cahn 2000 Recording Microbalance with a resolution of about 0.1 μg and a Rame Harte Vertical Platform Assembly, which moves vertically at uniform speeds down to a fraction of a micron per second.

About 50 ml of the liquid of interest is placed beneath the microbalance on the platform in a cylindrical container with a diameter of about 5 cm. A rectangular sample approximately 1 cm by 2 cm is cut from the polymer film with shears or with a razor knife depending on the thickness of the film. The sample should be flat and of uniform thickness and must be relatively rigid. It is important that the edges be straight, square and sharp and that the surface be free of fingerprints or other contamination. The sample is suspended from the microbalance by means of a small hook fastened with glue or tape to the center of one of the short edges. The hook should be bent gently so that the sample hangs vertically with its bottom edge parallel to the liquid surface, and the liquid container should be centered beneath it. The platform is raised by means of a coarse motor until the liquid surface is within 1 mm but not touching the bottom edge of the film. The alignment and position of the film may be easily determined by observation of the reflection of the film edge in the liquid surface. After adjustment of the microbalance to tare away the weight of the sample the net force is recorded as an apparent mass reading. The fine motor on the platform is then used to raise the liquid surface at a speed of about 2.5 μm per second. When the liquid makes contact with the film edge a force due to the adhesion tension is recorded. By means of the continued elevation of the platform the film is slowly immersed to a depth of about 0.4 cm at which point the test is discontinued and the platform is returned to its initial level.

During the immersion, random fluctuations in the force are observed due to inhomogeneities on the film surface while the average force decreases gradually because of the effect of buoyancy. The wetting force is determined by extrapolation of a line drawn through the force reading back to the point where initial contact of the film with the surface was made. At this point buoyancy does not contribute to the force. The perimeter of the film edge is then determined by careful measurement of the length of the bottom edge and the thickness of the film by means of a caliper and micrometer. The adhesion tension is calculated according to the following formula:

$$a = \frac{mg}{2(w + t)}$$

where a=adhesion tension, dyne/cm m=balance reading, g g=acceleration of gravity (=977.2 cm/sec$^2$ at Kingsport, Tenn.)

w=width of bottom edge of sample, cm t=film thickness, cm

The invention has been described in detail with particular reference to preferred embodiments thereof, but it will be understood that variations and modifications can be effected within the spirit and scope of the invention. Moreover, all patents, patent applications (published or unpublished, foreign or domestic), literature references or other publications noted above are incorporated herein by reference for any disclosure pertinent to the practice of this invention.

We claim:

1. An article of manufacture consisting of a toy having a plurality of synthetic fibers capable of spontaneously transporting water on the surface thereof, said fibers satisfying the following equation $$(1 - X \cos \theta_a) < 0,$$

wherein $\theta_a$ is the advancing contact angle of water measured on a flat film made from the same material as the fiber and having the same surface treatment, if any, X is a shape factor of the fiber cross-section that satisfies the following equation $$X = \frac{P_w}{4r + (\pi - 2)D}$$

wherein $P_w$ is the wetted perimeter of the fiber and r is the radius of the circumscribed circle circumscribing the fiber cross-section and D is the minor axis dimension across the fiber cross-section.

2. The article of claim 1 which satisfies the equation $$\gamma_{LA} \cdot \frac{12\pi \cdot 10^{-4}}{\sqrt{\rho}} \cdot \sqrt{dpf} \cdot (1 - X \cos \theta_a) \leqq -0.3,$$

wherein $\gamma_A$ is the surface tension of water in air in dynes/cm, $\rho$ is the fiber density in grams/cc, and dpf is the denier of the single fiber.

3. The article of claim 1 wherein said plurality of fibers define only a portion of said article, at least a portion of said plurality of fibers defining a visible portion thereof arranged in a predetermined physical configuration.

4. The article of claim 1 further comprising at least one groove wherein the width of each groove in said fiber cross-section at any depth in the groove is equal to or less than the width of the groove at its mouth.

5. The article of claim 1 wherein $$2\frac{r}{D}$$

for said fiber cross-section is greater than 1.

6. The article of claim 1 wherein $$2\frac{r}{D}$$

for said fiber cross-section is between 1.5 and 5.

7. The article of claim 1 wherein X for said fiber cross-section is greater than about 1.2.

8. The article of claim 1 wherein X for said fiber cross-section is from about 1.2 to about 5.

9. The article of claim 1 wherein X for said fiber cross-section is from about 1.5 to about 3.

10. The article of claim 1 wherein X for said fiber cross-section is greater than about 3.

11. The article of claim 1 wherein said fiber has a single fiber denier of between 3 and 1,000.

12. The article of claim 1 wherein said fiber has a single fiber denier of between 10 and 70.

13. The article of claim 1 wherein said fiber has an effective adhesion tension for water of greater than about 38 dynes/cm.

14. The article of claim 1 wherein said fiber has an effective adhesion tension for water of greater than about 45 dynes/cm.

15. The article of claim 1 wherein said fiber has coated thereon a layer of a hydrophilic lubricant.

16. The article of claim 15 wherein said hydrophilic lubricant is selected from the group consisting of (1) 49% polyethylene glycol (PEG) 600 monolaurate, polyoxyethylene (13.64) monolaurate, 49% polyethylene glycol (PEG) 400 monolaurate, polyoxyethylene (9.09) monolaurate, and 2% 4-cetyl-4 ethylmorpholinium ethosulfate (antistat);
(2) a modified polyester surfactant;
(3) a soil release agent consisting of polyester, water and other ingredients;
(4) polyoxyethylene (23) lauryl ether;
(5) polyoxyethylene (20) oleyl ether;
(6) polyoxyethylene glyceride ester, a nonionic surfactant; and
(7) a polyoxylene-polyoxypropylene sorbitan linoleic phthalic ester.

17. The article of claim 15 wherein said fiber comprises poly(ethylene terephthalate) and said hydrophilic lubricant is a potassium lauryl phosphate based lubricant comprising about 70 weight percent poly-(ethylene glycol) 600 monolaurate which is uniformly applied at a level of at least about 0.05% by weight of the total fiber.

18. The article of claim 15 wherein said hydrophilic lubricant is a potassium lauryl phosphate based lubricant comprising about 70 weight percent poly-(ethylene glycol) 600 monolaurate which is uniformly applied at a level of at least about 0.5% by weight of the total fiber.

19. The article of claim 1 wherein said fiber has been plasma treated.

20. The article of claim 1 wherein said fiber is helically crimped.

21. The article of claim 20 wherein said helical crimping of fiber occurs through a process for helically crimping said fiber having both a major and a minor axis of symmetry, wherein quenching by air occurs perpendicular to the major axis of the fiber.

22. The article of claim 21 wherein said process of crimping fiber comprises the following steps:

(A) extruding a PET fiber forming polymer;
(B) passing the polymer through spinneret hole shapes;
(C) orienting said spinneret hole shapes to the cross-flow quench air so that quenching occurs perpendicular to the major axis of the fiber;
(D) controlling the quench air;
(E) applying hydrophilic lubricants;
(F) taking up the fibers at conventional speeds;
(G) drafting the fibers using conventional drafting (single steam stage in steam or two stage in water and steam);
(H) adding an additional amount of hydrophilic lubricant; and
(I) relaxing the drawn fibers in a heated chamber to develop the helical crimp.

23. An article of manufacture according to claim 1 further comprising surface colorants wherein said surface colorants comprise edible household products in water solutions.

24. An article of manufacture according to claim 1 wherein said article of manufacture is a doll and further wherein said fibers comprise a doll's hair.

25. An article of manufacture according to claim 24 wherein said doll's hair is arranged in the form of a wig for demountable application to a doll's head.

26. An article of manufacture according to claim 24 wherein said doll's hair is permanently secured to a doll's head.

27. A process of surface coloration at a plurality of fibers which are attached to said article of manufacture of claim 1 wherein said process comprises the steps of surface coloration of said fibers with an aqueous surface colorant or surface colorants, rinsing said surface colorant with an aqueous fluid, and subsequent surface recoloration of said fibers.

28. The process of claim 27 wherein said aqueous surface colorant is food coloring.

29. The process of claim 27 wherein said aqueous fluid is water.

30. The process of claim 29 wherein said water is tap water or water wherein its temperature is room temperature.

* * * * *